US007651577B2

(12) United States Patent
Hiskey et al.

(10) Patent No.: US 7,651,577 B2
(45) Date of Patent: Jan. 26, 2010

(54) THERMALLY STABLE COMPOSITIONS INCLUDING 2,4,8,10-TETRANITRO-5H-PYRIDO[3',2':4,5][1,2,3]TRIAZOLO[1,2-A] BENZOTRIAZOL-6-IUM, INNER SALT

(75) Inventors: Michael A. Hiskey, Los Alamos, NM (US); My Hang Huynh, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 364 days.

(21) Appl. No.: 11/879,842

(22) Filed: Jul. 18, 2007

(65) Prior Publication Data

US 2008/0185081 A1 Aug. 7, 2008

Related U.S. Application Data

(62) Division of application No. 10/743,574, filed on Dec. 22, 2003, now abandoned.

(51) Int. Cl.
*C06B 25/34* (2006.01)
*C07D 249/16* (2006.01)

(52) U.S. Cl. ..... 149/92; 548/258

(58) Field of Classification Search ..... 149/92; 548/258

See application file for complete search history.

(56) References Cited

U.S. PATENT DOCUMENTS 3,166,567 A * 1/1965 Carboni ..... 548/258

FOREIGN PATENT DOCUMENTS

EP 0104717 * 4/1984

* cited by examiner

*Primary Examiner*—Taylor Victor Oh
(74) *Attorney, Agent, or Firm*—Holly L. Teeter; Samuel L. Borkowsky

(57) ABSTRACT

An explosive formulation including 2,4,8,10-tetranitro-5H-pyrido[3',2':4,5][1,2,3]triazolo[1,2-a]benzotriazol-6-ium, inner salt and a high temperature binder is disclosed together with a process of preparing 2,4,8,10-tetranitro-5H-pyrido[3',2':4,5][1,2,3]triazolo[1,2-a]benzotriazol-6-ium, inner salt.

4 Claims, No Drawings

THERMALLY STABLE COMPOSITIONS INCLUDING 2,4,8,10-TETRANITRO-5H-PYRIDO[3',2':4,5][1,2,3]TRIAZOLO[1,2-A] BENZOTRIAZOL-6-IUM, INNER SALT

RELATED APPLICATIONS

This application is a division of application Ser. No. 10/743,574, filed Dec. 22, 2003 now abandoned.

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention relates generally to thermally stable compositions including 2,4,8,10-tetranitro-5H-pyrido[3',2':4,5][1,2,3]triazolo[1,2-a]benzotriazol-6-ium, inner salt, to essentially acid-free 2,4,8,10-tetranitro-5H-pyrido[3',2':4,5][1,2,3]triazolo[1,2-a]benzotriazol-6-ium, inner salt, and to a process of preparing essentially acid-free 2,4,8,10-tetranitro-5H-pyrido[3',2':4,5][1,2,3]triazolo[1,2-a]benzotriazol-6-ium, inner salt.

BACKGROUND OF THE INVENTION

High (secondary) explosives with extremely high thermal stability are useful in both civilian and military applications. The major civilian use of such materials is in shape charges for increasing the yield of oil wells by penetrating the surrounding rock. Shaped charges are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

The (secondary) explosive in "down hole penetrators" must often withstand temperatures greater than about 200° C. for several hours up to a day or more and still initiate and perform reliably. In addition, as with all applications involving explosives, the performance needs a maximum output with a minimum of sensitivity. Currently, one explosive of choice for down hole penetrators used at high temperatures is 2,2',4,4',6,6'-hexanitrostilbene (HNS), see, e.g., U.S. Pat. No. 4,527,481. HNS has the advantage of having a high thermal stability (315° C.) with a reasonably good performance. Disadvantages of HNS include its relative sensitivity and a high cost due to a lengthy purification process. Another potential explosive for down hole penetrators is DAAF (diaminoazoxyfurazan). DAAF has an 18% better penetration performance than HNS and it is more insensitive to mechanical stresses while still remaining initiable. A disadvantage of DAAF is it has thermal stability to only 250° C. which is too low for some oil wells.

U.S. Pat. No. 3,166,567 describes compounds such as tetranitro-2,3:4,5-dibenzo-1,3a,6,6a-tetraazapentalene as insensitive explosive materials. However, that material is difficult to prepare due to low yields, the need for high temperatures for long periods and difficult purification and separation steps.

Recently, another compound, 2,4,8,10-tetranitro-5H-pyrido[3',2':4,5][1,2,3]triazolo[1,2-a]benzotriazol-6-ium, inner salt, was examined for potential application as a down hole penetrator. The synthesis of 2,4,8,10-tetranitro-5H-pyrido[3',2':4,5][1,2,3]triazolo[1,2-a]benzotriazol-6-ium, inner salt had been previously reported in the literature by Belgian scientists in 1983. In addition to the preparation of 2,4,8,10-tetranitro-5H-pyrido[3',2':4,5][1,2,3]triazolo[1,2-a]benzotriazol-6-ium, inner salt, the reference (Maquestiau et al., Bull. Soc. Chim. Belg., v. 92, no. 1, pp. 67-75,1983) reported a melting point of greater than 300° C. for the compound. When the compound was prepared in accordance with the description in the reference, the resultant compound was found to include residual acid when pressing the compound in metal dies resulted in etching of the metal dies. As use in a down hole penetrator typically involves use of a metal casing, such residual acid would be detrimental.

Accordingly, the development of an acid-free compound and a process of preparing such an acid-free compound was sought.

SUMMARY OF THE INVENTION

In accordance with the purposes of the present invention, as embodied and broadly described herein, the present invention includes explosive formulation including 2,4,8,10-tetranitro-5H-pyrido[3',2':4,5][1,2,3]triazolo[1,2-a]benzotriazol-6-ium, inner salt and a binder having high temperature stability at temperatures greater than about 350° C. The present invention further includes the explosive formulation including 2,4,8,10-tetranitro-5H-pyrido[3',2':4,5][1,2,3]triazolo[1,2-a]benzotriazol-6-ium, inner salt and a fluorocarbon polymer binder.

The present invention further includes a process of preparing 2,4,8,10-tetranitro-5H-pyrido[3',2':4,5][1,2,3]triazolo[1,2-a]benzotriazol-6-ium, inner salt including reacting 1H-benzotriazole with 2-chloro-3-nitropyridine to form a first intermediate product, reacting said first intermediate product with triethyl phosphite to form a second intermediate product, nitrating said second intermediate product with a mixture of sulfuric acid and nitric acid to form a third intermediate product, and purifying said third intermediate product to 2,4,8,10-tetranitro-5H-pyrido[3',2':4,5][1,2,3]triazolo[1,2-a]benzotriazol-6-ium, inner salt.

The present invention still further provides an improvement in processes of perforating underground formations such as oil wells using a shape charge including an explosive material and a binder, wherein the improvement is using 2,4,8,10-tetranitro-5H-pyrido[3',2':4,5][1,2,3]triazolo[1,2-a]benzotriazol-6-ium, inner salt as the explosive material.

DETAILED DESCRIPTION

The present invention is concerned with the preparation of essentially acid-free 2,4,8,10-tetranitro-5H-pyrido[3',2':4,5][1,2,3]triazolo[1,2-a]benzotriazol-6-ium, inner salt and in particular formulations including this compound. Also, the present invention is concerned with the use of essentially acid-free 2,4,8,10-tetranitro-5H-pyrido[3',2':4,5][1,2,3]triazolo[1,2-a]benzotriazol-6-ium, inner salt in shaped charges for down hole penetrators.

By the term "essentially acid-free" is meant that there is little or no acid present so that such an essentially acid-free material does not result in etching of metal when contacted with a metal die or part.

While 2,4,8,10-tetranitro-5H-pyrido[3',2':4,5][1,2,3]triazolo[1,2-a]benzotriazol-6-ium, inner salt was a previously reported compound, it was recognized that the formation of the desired compound was best accomplished by a different synthetic approach. Here, synthesis of 2,4,8,10-tetranitro-5H-pyrido[3',2':4,5][1,2,3]triazolo[1,2-a]benzotriazol-6-ium, inner salt is described, as well as some of the properties of this thermally stable material.

The preparation of 2,4,8,10-tetranitro-5H-pyrido[3',2':4,5][1,2,3]triazolo[1,2-a]benzotriazol-6-ium, inner salt can be as follows. Readily available 1H-benzotriazole can be reacted with 2-chloro-3-nitropyridine to form a first intermediate product. This first intermediate product can be reacted with a phosphite such as triethyl phosphite to form a second intermediate product. This second intermediate product can then be nitrated, e.g., with a mixture of sulfuric acid and nitric acid, preferably 90 percent by weight nitric acid, to form acid-containing 2,4,8,10-tetranitro-5H-pyrido[3',2':4,5][1,2,3]triazolo[1,2-a]benzotriazol-6-ium, inner salt. Purification can be conducted to remove the acid and form essentially acid-free 2,4,8,10-tetranitro-5H-pyrido[3',2':4,5][1,2,3]triazolo[1,2-a]benzotriazol-6-ium, inner salt.

The product, 2,4,8,10-tetranitro-5H-pyrido[3',2':4,5][1,2,3]triazolo[1,2-a]benzotriazol-6-ium, inner salt, was found to be thermally stable up to 365° C. (differential scanning calorimetry), and the heat of formation was measured to be +106 $kJmol^{-1}$ by combustion calorimetry. The product had a density of 1.84 $g/cm^3$ as measured by gas pycnometer. Measured sensitivity properties include a drop weight impact value of 59 cm (in comparison, the drop weight value for HMX is 23 cm) and when blended with 5 percent by weight of Kel-F® fluorocarbon polymer, the material had a drop weight impact value of 155 cm (the comparative value for a similar HNS blend is 54 cm). The compound was also found insensitive to initiation by spark (0.36 J) or friction (BAM, >36 kg). Finally, the product was found to have a measured detonation velocity of 7.43 km/sec and a measured detonation pressure of 294 kbar at a density of 1.78 $g/cm^3$ in a 0.5-inch rate stick and a failure diameter of less than 3 mm. In comparison, HNS has a measured detonation velocity of 7.00 km/sec and a calculated detonation pressure of 200 kbar.

It was found that when prepared in accordance with the reference by Maquestiau et al., Bull. Soc. Chim. Belg., v. 92, no. 1, pp. 67-75, 1983, the product compound, 2,4,8,10-tetranitro-5H-pyrido[3',2':4,5][1,2,3]triazolo[1,2-a]benzotriazol-6-ium, inner salt, had acid impurities that resulted in etching of metal dies used to press the compound. By purification of the compound using the process of the present invention, the compound was then successfully pressed without etching of the metal dies. This acid-free product is desirable for use in shaped charges including metal casings and/or linings.

The purified compound can be incorporated into an explosive formulation including a binder. Preferably, the binder has high temperature stability at temperatures greater than about 300° C., more preferably greater than about 350° C. Suitable binder materials include fluorocarbon polymers including polymers of chlorotrifluoroethylene, copolymers of materials such as vinylidene fluoride, hexafluoropropylene and the like, and terpolymers of vinylidene fluoride, hexafluoropropylene and tetrafluoroethylene and the like. Among the suitable binder materials are included Kel-F® fluorocarbon polymers (trademarked products commercially available from 3M Co.), Viton A® fluorocarbon polymers (trademarked products commercially available from E.I. DuPont de Nemours & Co.) and Fluorel® fluorocarbon polymers (trademarked products commercially available from 3M Co.).

The present invention is more particularly described in the following examples which are intended as illustrative only, since numerous modifications and variations will be apparent to those skilled in the art.

EXAMPLE 1

A flask containing 11.91 g 1H-benzotriazole (0.1 mole), 15.85 g 2-chloro-3-nitropyridine (0.1 mol), 12.3 g anhydrous sodium carbonate and 250 ml acetonitrile was refluxed with vigorous stirring for 24 hours. The acetonitrile was then distilled and recovered and 250 ml of water was added to the residue in the flask. The solid was stirred vigorously for 1 hour and then filtered and the light yellow precipitate was washed with water and air dried to yield 21.4 g (89%) of the crude product, 1-(3-Nitro-2-pyridyl)-1H-benzotriazole, of sufficient purity for the next step.

EXAMPLE 2

To a flask containing 350 ml of xylenes and 65 ml of triethyl phosphite was added 21.4 g of 1-(3-nitro-2-pyridyl)-1H-benzotriazole from Example 1 and the mixture was refluxed for 24 hours. The xylenes were then distilled and recovered and hexanes were added to the dark semi-solid residue. The yellow product was filtered and washed with hexanes and air dried to yield 12.8 g (69%) of 5H-pyrido[3',2':4,5][1,2,3]triazolo[1,2-a]benzotriazol-6-ium inner salt.

EXAMPLE 3

To 130 ml of 98% sulfuric acid at 5° C. was added 12.8 g of 5H-pyrido[3',2':4,5][1,2,3]triazolo[1,2-a]benzotriazol-6-ium inner salt with vigorous stirring. After complete dissolution, 130 ml of 90% nitric acid was added dropwise with intensive cooling keeping the temperature below 30° C. The mixture was then heated to 80° C. for 2 hours, cooled and poured onto ice. The product was filtered, washed with water and air dried to yield 17.8 g (74%) of 2,4,8,10-tetranitro-5H-pyrido[3',2':4,5][1,2,3]triazolo[1,2-a]benzotriazol-6-ium inner salt. The material was then triturated with acetone, acetonitrile and methanol to completely remove any residual acid.

EXAMPLE 4

The product of Example 3 was found by differential scanning calorimetry to be thermally stable up to 365° C., and the heat of formation was measured to be +106 $kJmol^{-1}$ by combustion calorimetry. The product had a density of 1.84 $g/cm^3$ as measured by gas pycnometer. Measured sensitivity properties included a drop weight impact value of 59 cm and when blended with 5 percent by weight of Kel-F® fluorocarbon polymer, the material had a drop weight impact value of 155 cm. The product was also found insensitive to initiation by spark (0.36 J) or friction (BAM, >36 kg). Finally, the product was found to have a measured detonation velocity of 7.43 km/sec and a measured detonation pressure of 294 kbar at a density of 1.78 $g/cm^3$ in a 0.5 inch rate stick and a failure diameter of less than 3 mm.

Although the present invention has been described with reference to specific details, it is not intended that such details should be regarded as limitations upon the scope of the invention, except as and to the extent that they are included in the accompanying claims.

What is claimed is:

1. In a process of perforating underground formations using a shape charge including an explosive material and a binder, the improvement wherein the explosive material is 2,4,8,10-tetranitro-5H-pyrido[3',2':4,5][1,2,3]triazolo[1,2-a]benzotriazol-6-ium, inner salt.

2. The process of claim 1 wherein said 2,4,8,10-tetranitro-5H-pyrido[3',2':4,5][1,2,3]triazolo[1,2-a]benzotriazol-6-ium, inner salt is essentially acid-free.

3. The process of claim 1 wherein said 2,4,8,10-tetranitro-5H-pyrido[3',2':4,5][1,2,3]triazolo[1,2-a]benzotriazol-6-ium, inner salt is admixed with the binder having high temperature stability at temperatures greater than about 350° C.

4. The process of claim 1 wherein the binder has high temperature stability at temperatures greater than about 350° C.

* * * * *